United States Patent [19]

Sutton

[11] Patent Number: 4,509,446

[45] Date of Patent: Apr. 9, 1985

[54] DRYDOCKING DEVICE HAVING A MOMENT RESISTING ARRANGEMENT

[75] Inventor: John R. Sutton, Beaumont, Tex.

[73] Assignee: Marine Concepts, Inc., Beaumont, Tex.

[21] Appl. No.: 451,923

[22] Filed: Dec. 21, 1982

[51] Int. Cl.[3] ..... B63B 35/42

[52] U.S. Cl. ..... 114/45; 405/3; 114/125

[58] Field of Search ..... 114/44, 45, 46, 49, 114/50, 52, 53, 121, 125; 405/3, 7; 254/389

[56] References Cited

U.S. PATENT DOCUMENTS

| | | | |
|---|---|---|---|
| 979,519 | 12/1910 | Larson | 254/389 |
| 3,559,606 | 2/1971 | Gregory | 114/44 |
| 3,688,719 | 9/1972 | Amirikian | 405/3 |
| 3,890,915 | 6/1975 | Herreshoff | 114/302 |

*Primary Examiner*—Trygve M. Blix
*Assistant Examiner*—Edwin L. Swinehart
*Attorney, Agent, or Firm*—Burns, Doane, Swecker & Mathis

[57] ABSTRACT

The present invention relates to a drydocking method and apparatus including a moment resisting arrangement for maintaining the drydocking device in a substantially horizontal plane while raising or lowering a vessel relative to a surface of a body of water. The drydocking device includes a submersible pontoon having a first side positioned adjacent to a single fixed structure and having an arrangement for selectively introducing air or water into at least one chamber within the pontoon for raising and lowering the pontoon, respectively. The pontoon has a moment resisting arrangement which includes a cable secured to the fixed structure and extending around a first sheave positioned adjacent to the first side of the pontoon. The cable extends across the pontoon and around a second sheave positioned adjacent to a second opposite side of the pontoon to an anchoring arrangement beneath the second side of the pontoon. The moment resisting arrangement also includes at least one permanent void tank and at least one permanent ballast tank positioned within the pontoon for creating an induced moment tending to rotate the first side of the pontoon downwardly. In operation, the induced moment resists external moments due to eccentrically positioned vessels which tend to rotate the second side downwardly, and the cable resists the induced moment and other external moments due to eccentrically positioned vessels which tend to rotate the first side downwardly.

6 Claims, 5 Drawing Figures

DRYDOCKING DEVICE HAVING A MOMENT RESISTING ARRANGEMENT

BACKGROUND AND SUMMARY OF THE PRESENT INVENTION

The present invention relates to a drydocking method and apparatus for raising a vessel from a body of water. More specifically, the present invention concerns a drydocking method and apparatus including a moment resisting arrangement for maintaining a platform in a substantially horizontal plane while raising and lowering the vessel supported thereon.

It is known in the shipping art that repairs on a floating vessel are facilitated if the vessel can be lifted from a body of water. Various devices for vertically moving or "drydocking" a vessel are known. However, these drydocking devices have several disadvantages.

One known drydocking device is a graving dock which includes a basin adjacent to a body of water. The basin is capable of being filled with water through a gate which separates the basin and the body of water. In operation, the vessel floats through the gate and, after closing the gate, water is pumped from the basin so that the vessel rests on the floor of the basin. The vessel is launched by refilling the basin and floating the vessel into the adjacent body of water. The graving dock, however, requires large quantities of water to be pumped into and out of the entire basin to drydock the vessel, regardless of the size of the vessel. Further, the graving dock occupies large areas of valuable waterfront property which may be put to a more beneficial use.

Elevator-type drydocks are also known in the art. These drydocks include mechanical devices such as winches or hydraulic rams for lifting or lowering a vessel. Elevator drydocks, however, require mechanical devices with large lifting capacities which must be synchronized so as not to overload a particular device or tilt the vessel.

Wing-walled floating drydocks are also known. These drydocks include a pontoon having bouyant vertical walls (wing walls) on longitudinal sides of the pontoon. The pontoon is divided into numerous internal compartments for stabilizing the pontoon while lifting a vessel situated between the wing walls. The wing-walled floating drydock, however, requires complex piping and valving mechanisms for simultaneously flooding or evacuating each compartment within the pontoon.

Another drydocking device includes a submersible barge situated between two fixed structures, such as a pier and a piling. The barge has first and second pulleys located on a side of the barge adjacent to the pier and third and fourth pulleys located on a side of the barge adjacent to the piling. A first chain extends from a top of the pier around the first and third pulleys to a base of the piling. A second chain extends from a top of the piling and around the fourth and second pulleys to a base of the pier. In operation, the vessel is positioned between the two fixed structures and above the submerged barge. The barge is evacuated to raise the vessel thereon while the two chains maintain the barge in a horizontal plane. Such a drydocking arrangement, however, requires two fixed structures which increases the expense of the drydocking device and prevents ready access to the barge from two sides. A device of this type is disclosed in U.S. Pat. No. 3,559,606 issued to Gregory.

A common problem associated with both wing-walled floating drydocks and submersible barges is the maintainance of the drydocking device in a substantially horizontal plane while raising or lowering the vessel supported on the drydocking device. This problem of stability becomes exacerbated if the center of gravity of the vessel is not aligned with the center of bouyancy of the drydocking device, i.e., the vessel is eccentrically positioned with respect to the center of bouyancy of the device. Eccentrically positioned vessels create capsizing moments tending to rotate the device out of the horizontal plane. The above-described known devices maintain stability with wing-walls or with chains extending between two fixed structures, but in doing so limit vessel access to the drydocking device to the ends of the device between the wing walls or the fixed structures.

An additional problem associated with the stability of wing-walled floating drydocks and submersible barges is that the positioning of the vessel on these known drydocking devices is critical. The positioning of the vessel on these devices must be closely monitored so that the moment created by an eccentrically positioned vessel does not exceed a moment resisting tolerance of the wing-walls or the chains. Therefore, the eccentricity of a vessel positioned on known drydocking devices must be minimized.

The present invention concerns drydocking method and apparatus including a moment resisting arrangement which maintains the drydocking device in a substantially horizontal plane without impeding vessel access to the drydocking device and without closely monitoring the positioning of the vessel on the device. In order to eliminate the numerous internal compartments and the associated complex valving and piping arrangements employed in wing-walled floating drydocks, the present invention includes a submersible pontoon having at least one internal chamber into which air and water are introduced. The pontoon has an arrangement for selectively introducing air or water into the chamber for raising and lowering the pontoon so that there is no need for mechanical lifting devices as in elevator drydocks. At least one portion of a first side of the pontoon is positioned adjacent to a single fixed structure so that the drydocking device with the moment resisting arrangement of the present invention does not occupy an extensive area of waterfront property.

The moment resisting arrangement includes a cable secured to the fixed structure and extending under and around a first sheave positioned adjacent to the first side of the pontoon. The cable extends across the pontoon and passes over a second sheave positioned adjacent to a second side of the pontoon opposite from the first side. The cable is anchored to an anchoring mechanism positioned beneath the pontoon so as not to limit vessel access to pontoon to only the ends of the device. The cable extended between the fixed structure and the anchoring mechanism has a moment resisting capacity sufficient to resist external moments due to eccentrically positioned vessels which tend to rotate the first side of the pontoon downwardly.

The moment resisting arrangement also includes an arrangement for creating an induced moment which tends to rotate the first side of the pontoon downwardly. The induced moment resists external moments due to an eccentric vessel which tends to rotate the second side of the pontoon downwardly. Preferably, the arrangement for creating an induced moment includes a permanent void tank(s) and a permanent ballast tank(s), both of which are sealed tanks positioned within the pontoon.

In operation, the pontoon is positioned between the fixed structure and the anchoring arrangement. Air and water are selectively introduced into the chamber within the pontoon in order to raise and lower the pontoon. If the center of gravity of a vessel on the pontoon does not align with the center of bouyancy of the pontoon, then a resulting moment tending to rotate the pontoon from a substantially horizontal plane is resisted by either the cable extending between the fixed structure and the anchoring arrangement or by the induced moment created by the permanent void tank(s) and/or the permanent ballast tank(s).

Many objects and advantages derived from the present invention will become apparent to those skilled in the art from this specification.

BRIEF DESCRIPTION OF THE DRAWINGS

Preferred embodiments of the present invention will be described in greater detail with reference to the accompanying drawings, wherein like members bear like reference numerals, and wherein.

DETAILED DESCRIPTION OF THE PREFERRED EMBODIMENT

Figure 1:
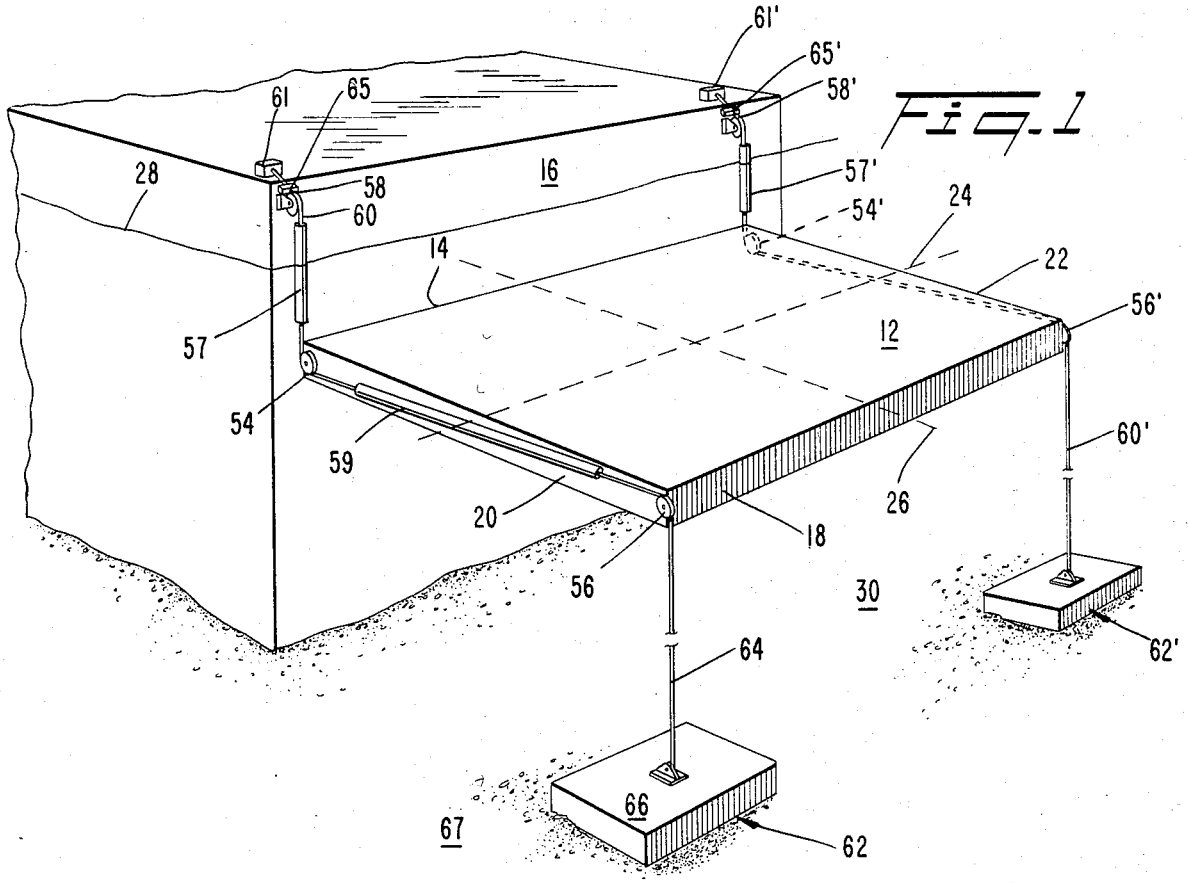
FIG. 1 is a perspective view of the drydocking device having moment resisting arrangements on two parallel sides of the drydocking device.

With reference to FIG. 1, the drydocking device according to the present invention includes a pontoon 12 having at least a portion of a first longitudinal side 14 positioned adjacent to a fixed structure 16 and a second longitudinal side 18 which is opposite to the first side 14. A first transverse side 20, and a second transverse side 22 extend between the first and second sides 14, 18. The pontoon 12 is symmetrical about both a longitudinal axis 24 and a transverse axis 26. The pontoon is adapted for supporting a load (not shown) and for raising or lowering the load relative to a water surface 28 of a body of water 30. In a typical application of the present invention, the load being raised or lowered corresponds to a vessel (not shown) to be drydocked.

Figure 2:
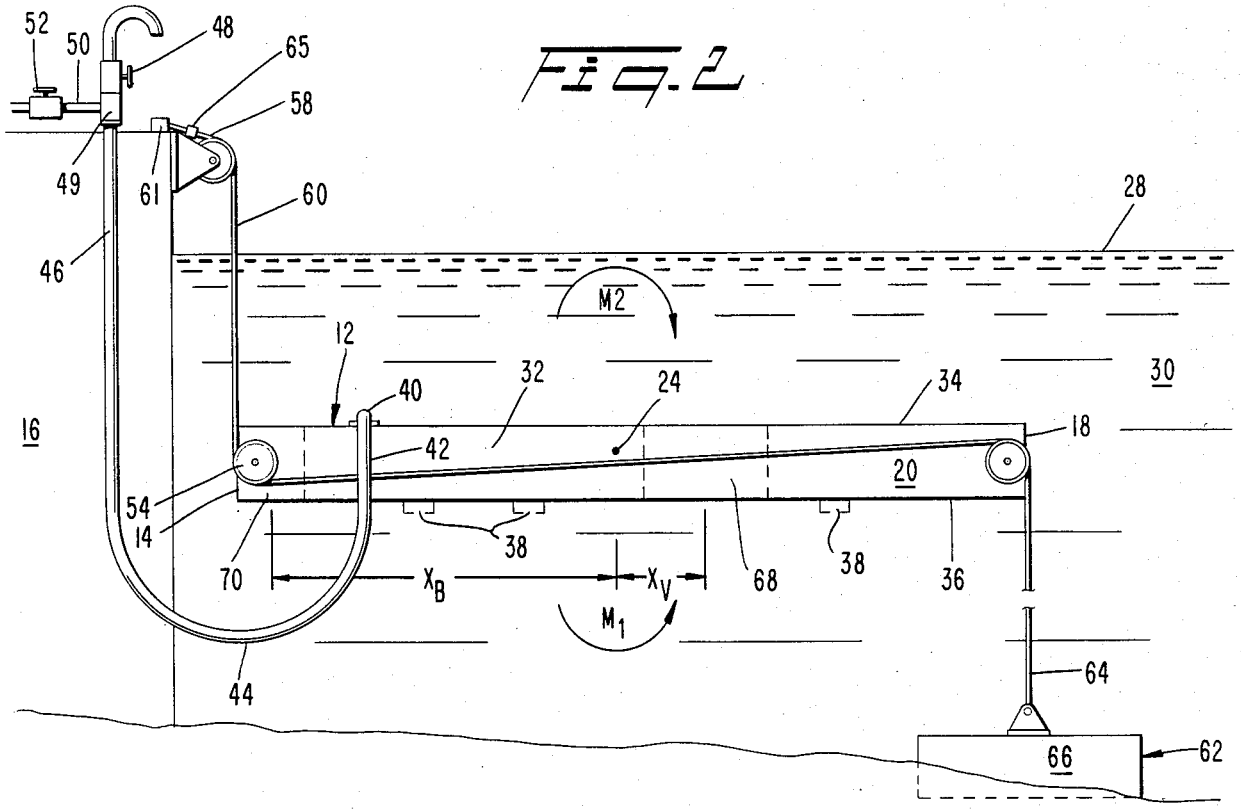
FIG. 2 is a transverse end elevational view of a first embodiment of a drydocking device according to the present invention.

The pontoon 13 is raised or lowered by an arrangement for selectively introducing air or water into at least one chamber 32 within the pontoon. With reference to FIG. 2, an upper deck 34, an underside 36 and the sides 14, 18, 20, 22 of the pontoon 12 are constructed so that the chamber(s) 32 within the pontoon 12 is airtight. Permanent openings 38 may be provided on the underside 36 of the pontoon 12 to define a passage arrangement for allowing water to freely enter or leave the chamber 32. Alternatively, the passage arrangement may include remotely actuated valves arranged on the underside 36 of the pontoon 12 for selectively introducing water into or evacuating water from the chamber 32.

The pontoon 12 has an arrangement for selectively introducing air into or evacuating air from the chamber(s) 32. The arrangement includes a valving mechanism having a vent(s) 40 which communicates with the chamber 32 and which is connected near or into the upper deck 34 of the pontoon 12. Preferably, the vent(s) 40 is located adjacent or near to the first side 14 of the pontoon in order to be more accessible to the fixed structure 16. A lower end 42 of a flexible hose 44 is connected to the vent flange 40 on the pontoon 12 and an upper end 46 of the hose 44 is connected to a vent pipe 49 which may be conveniently arranged on the fixed structure 16 above the water surface 28. A vent valve 48 is connected to the vent pipe 49 and, when opened, provides communication between the chamber 32 and the atmosphere to evacuate air from the chamber 32.

A source of pressurized air (not shown) communicates with the vent pipe 49 through a compressed air line 50. A selectively actuated inlet valve 52 is situated in the compressed air line 50 between the source of air and the vent pipe 49. When the vent valve 48 is closed and the inlet valve 52 is opened, pressurized air is introduced through the hose 42 to the chamber 32. The construction of the pontoon 12 and the chamber(s) 32 is such that air and water may enter or exit the chamber only through the above-described arrangements. One vent hose and valve arrangement is provided for each independent chamber.

In order to raise the pontoon 12, the vent valve 48 is closed and the inlet valve 52 is opened to allow pressurized air to enter the chamber 32 through the hose 44. Air entering the chamber 32 causes water to flow from the chamber 32 through the openings 38. Water acts as a seal within the opening 38 for preventing air from exiting from the chamber 32 through the openings 38. The chamber 32, in a water-evacuated condition, creates a predetermined bouyant force that provides substantially all of an upward force required to raise the pontoon with the vessel thereon.

Since the openings 38 are normally below the water surface 28 and the chamber 32 is air tight, the air is confined within the chamber 32 to create the predetermined buoyant force which overcomes the weight of the pontoon 12 and raises the pontoon 12 relative to the water surface 28. The pontoon 13 may then be maintained in a raised position by closing the inlet valve 52 with the vent valve 48 remaining in a closed position.

In order to lower the pontoon 12 from the raised position, the inlet valve 52 is kept closed and the vent valve 48 is opened. Water flows into the chamber 32 through the passage arrangement defined by the openings 38 to evacuate air from the chamber 32 and to decrease the buoyant force to lower the pontoon 12. It is noted that the flexible hose 44 has a length sufficient to accomodate a lowermost submerged position of the pontoon 12.

The vertical speed at which the pontoon 12 is raised or lowered may be automatically controlled by regulating the flow of air to and from the chamber 32. Thus, the relative sizes of the hose 44, the vent 40 and the permanent openings 38 are selected to regulate the flow of air and thereby automatically control the vertical speed of the pontoon 12. In addition, mechanisms for automatically controlling the rate at which air is introduced into and evacuated from the pontoon may be provided on the inlet valve 52 and vent valve 48 to regulate the speed at which the pontoon is raised or lowered. Computer control of mechanized valves for automatic control is also readily applicable to this invention. It is noted that automatically controlling the flow of air to and from the chamber 32 automatically regulates the flow of water through the permanent openings 38.

In positioning the vessel on the pontoon 12, it is possible that the center of gravity of the vessel does not align with the center of bouyancy of the pontoon. Misalignment of the center of gravity of the vessel and the center of bouyancy of the pontoon results in an eccentrically positioned vessel which tends to rotate the pontoon from a horizontal plane.

With reference to FIG. 2, an eccentrically positioned vessel having its center of gravity situated between the first side 14 and a longitudinal line parallel to the longitudinal axis 24 and passing through the center of bouyancy creates a first external moment in a first or counterclockwise direction (as viewed in FIG. 2 and indicated by arrow M1). The first external moment tends to rotate the first side 14 downwardly. An eccentric vessel having its center of gravity situated between the second side 18 and the longitudinal line parallel to the longitudinal axis 24 and passing through the center of bouyancy creates a second external moment in a second or clockwise direction (as viewed in FIG. 2 and indicated by arrow M2). The second external moment tends to rotate the second side 18 downwardly. Both first and second external moments applied to a drydocking device are resisted by the moment resisting arrangement of the present invention.

It is noted that the center of gravity of the eccentrically positioned vessel is located with reference to a longitudinal line parallel to the longitudinal axis 24 and passing through the center of bouyancy of the pontoon. The center of bouyancy of the pontoon, however, moves as the pontoon is raised and lowered and thus, the location of the longitudinal line passing through the center of bouyancy is not fixed. The movement of the center of bouyancy will be described more fully hereinafter.

Further, it is noted that FIG. 2 shows a transverse end elevational view of the pontoon employed in the drydocking device of the present invention with first and second external moments tending to rotate the pontoon about the longitudinal line which passes through the center of bouyancy of the drydocking device. However, the drydocking device having a moment resisting arrangement of the present invention is not limited to moments tending to rotate the pontoon about that longitudinal line. Moments tending to rotate the pontoon about a transverse line which is parallel to the transverse axis 26 and which passes through the center of bouyancy are also resisted by the drydocking device having an appropriately arranged moment resisting arrangement. Thus, to resist moments tending to rotate the pontoon about a longitudinal line passing through the center of bouyancy, moment resisting arrangements are located on transverse sides of the drydocking device, as illustrated in FIG. 1. To resist moments tending to rotate the pontoon about a transverse line passing through the center of bouyancy, moment resisting arrangements are located on longitudinal sides of the drydocking device.

Referring to FIG. 1, the pontoon 12 is provided with a moment resisting arrangement for resisting moments in the first counterclockwise direction. The arrangement includes a first sheave 54 positioned adjacent to the first side 14 of the pontoon 12 and a second sheave 56 positioned adjacent to the second side 18 of the pontoon 12. The sheaves 54, 56 are rotatably secured to the pontoon and preferably, the sheaves are rotatably mounted on the first transverse side 20 of the pontoon 12. A first end 58 of a moment resisting cable 60 is secured to the fixed structure 16 by an attachment mechanism 61 located on the fixed structure 16. The cable 60 extends downwardly from the securement mechanism 61 under the first sheave 54 and approximately horizontally across the transverse side 20 of the pontoon 12 to the second sheave 56. The cable lies over the second sheave 56 and extends downwardly to an anchoring arrangement 62 to which a second opposite end 64 of the cable 60 is secured. It is noted that the cable 60 may also extend across the upper deck 34 or the underside 36 of the pontoon 12. Further, it is noted that the preferred embodiment includes sheaves 54, 56 rotatably mounted on the pontoon 12, but any rotary mechanism operable to rotate with respect to the pontoon may be employed. Further, a rigid, solid member 59 may be incorporated into the cable system, preferably between the sheaves 56 on the pontoon. This solid member 59 must have a length and be positioned so as never to come into contact with either sheave as the pontoon goes up or down (the solid member moves horizontally across the end of the pontoon). This solid member 59 removes some of the stretch in the system caused by the elastic properties of wire rope.

The anchoring arrangement 62 may be a pile 66 driven into a floor 67 of the body of water 30 or a weight 66 attached to the second end 64 of the cable 60, as illustrated in the drawings. In either embodiment, it is preferred that the anchoring arrangement 62 be positioned beneath the lowermost submerged position of the pontoon 12 so as not to impede vessel access to the pontoon 12 from the second side 18 of the pontoon 12.

With reference to FIG. 1, the drydocking device of the present invention may employ a moment resisting arrangement on both tranverse sides 20, 22 of the pontoon 12. An additional moment resisting arrangement is arranged on the second opposite transverse side 22 in a plane generally parallel to a plane of the first-mentioned moment resisting arrangement positioned on the first transverse side 20. The additional moment resisting arrangement is similar to the first-mentioned moment resisting arrangement and includes an additional moment resisting cable 60' arranged generally parallel to the first-mentioned cable 60 and having a first end 58' secured to the fixed structure 16 by an additional securement mechanism 61'. The additional cable 60' extends under a third sheave 54' (shown in phantom lines) positioned adjacent to the first side 14 and then extends across the opposite transverse side 22 of the pontoon 12. The additional cable 60' passes over a fourth sheave 56' (shown partially) positioned adjacent to the second side 18 of the pontoon 12 and extends downwardly to an additional anchoring arrangement 62'. Preferably, both the third and fourth sheaves 54' 56' are substantially aligned with the first and second sheaves 54, 56, respectively, and the additional anchoring arrangement 62' is substantially aligned with the first-mentioned anchoring arrangement 62.

The present invention further includes an arrangement for resisting a second external moment in the second clockwise direction. With reference to FIG. 2, such an arrangement includes at least one air-filled permanent void tank(s) 68 positioned within the pontoon 12 between the longitudinal axis 24 and the second side 18 of the pontoon 12 and at a distance $X_V$ where $X_V$ is the distance from the longitudinal axis 24 to the centroid of the void tanks or the resultant centroid of the void tanks from the longitudinal axis 24. The permanent void tank(s) 68 is a sealed tank which does not communicate with the chamber 32 or the vent 40. Preferably, the permanent void tank(s) 68 is filled with air and creates a first variable induced moment in the first counterclockwise direction which resists the second external moment in the second clockwise direction.

The arrangement for creating an induced moment may also include one or more permanent ballast tank(s) 70 positioned within the pontoon 12 between the longitudinal axis 24 and the first side 14 and at a distance $X_B$ where $X_B$ is the distance from the longitudinal axis 24 to the centroid of the permanent ballast tank(s) or the resultant centroid of the permanent ballast tank(s) from the longitudinal axis 24. The permanent ballast tank 70 is also a sealed tank which does not communicate with the chamber 32 or the openings 38. Preferably, the permanent ballast tank 70 is filled with water and creates a second variable induced moment in the first counterclockwise direction M1 which second induced moment also resists second external moments in the second clockwise direction M2. It is noted that the permanent void tank(s) 68 and the permanent ballast tank(s) 70 must be capable of withstanding external pressure due to water when the pontoon 12 is submerged to its lowermost position. The tank(s) may be an integral prismatic type (as shown) or independent cylindrical or other prismatic type.

The induced moments created by the permanent void tank(s) 68 and the permanent ballast tank 70 have magnitudes which are variable. However, together the ballast and void tanks create a constant and known moment. For example, if the chamber 32 is completely filled with water, then the center of gravity of the pontoon 12 acts through a point on the fixed pier side of the longitudinal axis. The permanent void tank 68 creates the first variable induced moment in the first counterclockwise direction but, with the floodable chambers full, the second variable induced moment due to the permanent ballast tank 70 has a zero magnitude. As the chamber 32 fills with air to raise the pontoon 12, the voids lose their effectiveness since the pontoon is filling with air but, the effect of the permanent ballast tank(s) begins and maintains the overall center of gravity at the same point on the "fixed pier side" of the longitudinal centerline of pontoon and, thus maintains a constant counterclockwise moment, M1 in FIG. 1, as the air displaces the water in the pontoon. The identical effect occurs as the pontoon is lowered, i.e., water displaces the air in the floodable chambers.

In order to ensure a constant and known induced moment, it is especially preferred that the arrangement for constantly creating an induced moment include both a permanent void tank 68 and a permanent ballast tank 70. The distances $X_V$ and $X_B$ and the sizes of the permanent ballast tank 70 and the permanent void tank 68 can then be selected so that the sum or combination of the first and second variable induced moments respectively created by the permanent void tank 68 and the permanent ballast tank 70 is a known, constant induced moment in the first direction M1 for resisting second external moments in the second direction M2, regardless of the elevation of the pontoon in or above the water surface 28.

The moment resisting arrangement of the present invention operates as follows. An eccentric vessel having its center of gravity positioned between the center of bouyancy and the first side 14 creates a first external moment in the first counterclockwise direction M1. The first external moment has a magnitude equal to the product of the weight of the eccentric vessel and a horizontal distance between a point of application of the center of gravity of the vessel and the center of bouyancy of the vessel (the longitudinal centerline of pontoon). The cables 60, 60' are provided to resist moments in the first counterclockwise direction M1 which includes the induced moment and the first external moment. A maximum moment resisting capacity of the cables has a magnitude equal to the product of the tensile strength of the cables and the horizontal spacing between the first and second sheaves 54, 56. If the first external moment plus the induced moment exceeds the moment resisting capacity of both cables, then the pontoon 12 will tend to rotate in the first counterclockwise direction M1.

Due to the desired off-center position of the center of gravity, it is preferable to locate the permanent void tank 68 adjacent to the second side 18. An eccentrically positioned vessel having its center of gravity situated between the first side 14 and the center of bouyancy would then create a first external moment which is resisted by the moment resisting capacity of the cables. As the pontoon is raised, the center of gravity of the pontoon remains fixed and positioned off-center to the "pier side" of the longitudinal axis 24 of the pontoon. Should the center of gravity of the eccentric vessel be positioned between the longitudinal axis 24 of the pontoon and the second side 18, then the eccentric vessel creates a second external moment in the second clockwise direction. Under these circumstances, the second external moment is resisted to maintain the pontoon in a substantially horizontal plane, to the extent of the constant induced (built in) moment.

Thus, a maximum allowable external moment in the first clockwise direction is equal to the moment resisting capacity of the cables minus the induced moment created by the permanent void tank 68 and the permanent ballast tank 70. Further, the maximum allowable external moment in the second direction is equal to the induced moment created by the permanent ballast tank 70 and the permanent void tank 68. If the strength of the cables, the weight of the vessel and the magnitude of the induced moment are known, then one skilled in the art can determine the maximum distance that the vessel can be eccentrically positioned from principles of classical engineering mechanics.

It is preferred to have an arrangement for continuously monitoring the moments being resisted by the cables 60, 60' in order to monitor the extent to which the cables are being loaded. Load cells 65, 65' (FIG. 1) installed on each cable 60, 60' are capable of monitoring the load being applied to each cable. Since the load is directly proportional to the external moments, the moments being resisted by the cables 60, 60' can thus be monitored. Monitoring can also be accomplished by reading the pressure in hydraulic cylinders to which the cable could be attached on the fixed pier.

It is noted that if the anchoring arrangement includes a weight, then it is most economical and practical to use a weight having a weight value equal to the tensile strength of the cable. The use of a weight having a weight value less than the tensile strength of the cable requires the substitution of the weight value for the tensile strength of the cables in computing the moment resisting capacity of the cable. The use of a weight value greater than the tensile strength of the cables has no effect, since the tensile strength of the cables is a limiting factor in such a situation.

Further, the tensile strength of the cables 60, 60' is not designed for raising and lowering the pontoon 12. The primary purpose of the cables 60, 60' is to maintain the pontoon 12 in a substantially horizontal plane while raising and lowering the pontoon. The arrangement for selectively introducing air and water into the chamber 32 is capable of creating a water-evacuated condition within the chamber which condition provides the predetermined bouyant force for raising the pontoon 12. Thus, the predetermined bouyant force provides substantially all of a lifting force required to raise the vessel.

The use of the permanent void tank 68 and the permanent ballast tank 70 advantageously provides an additional mechanism for raising the pontoon should the arrangement for selectively introducing air or water into the chamber 32 fail. The size of the permanent void tank 68 is selected to create a bouyant force sufficient to raise the pontoon 12 when the permanent ballast tank is evacuated. The permanent ballast tank 70 is provided with an emergency valve (not shown) for evacuating water from the ballast tank 70. In the event the arrangement for selectively introducing air or water into the chamber 32 fails, the pontoon 12 may be raised by opening the emergency valve in the permanent ballast tank 70. Bouyant forces within the permanent void tank 68 and the evacuated permanent ballast are then sufficient to raise the pontoon.

If two moment resisting arrangements are provided as illustrated in FIG. 1, then the permanent void tank 68 and the permanent ballast tank 70 may be extended to the second transverse side 22. Alternatively, an additional permanent void tank and permanent ballast tank may be positioned adjacent to the second transverse side 22. The additional permanent void tank and permanent ballast tank may be substantially aligned with the first-mentioned permanent void tank 68 and permanent ballast tank 70.

With the above-described arrangement for constantly creating an induced moment and with the arrangement for selectively introducing air and water into the chamber, the pontoon 12 is internally divided into the chamber 32, the permanent ballast tank 70 and the permanent void tank 68. The chamber 32 itself may be further divided into a plurality of ballast chambers. Practical considerations, however, favor a minimum number of chambers since each additional chamber requires an additional valving arrangement for introducing air into and evacuating air from each chamber.

With the present invention, a drydocking device has a moment resisting arrangement which is capable of resisting external moments in both the first and second directions M1, M2. Further, the external moment in the second direction is resisted without the need for a second fixed structure or wing walls, both of which limit vessel access to the drydocking device to two transverse sides. The present invention provides a laterally stable drydocking device which permits unimpeded vessel access to the two transverse sides 20, 22 and the second side 18. Further, it is noted that only a portion of the fixed structure 16 is required to be adjacent to the first side 14 of the pontoon 12. In such a case, the fixed structure may be a pier or piling situated adjacent to a portion of the first side 14 of the pontoon 12. Under these circumstances, the present invention provides a laterally stable drydocking device which permits unimpeded vessel access to practically all four sides of the drydocking device.

The present invention also provides a drydocking device having a moment resisting arrangement wherein the positioning of the vessel with respect to a centerline of the device is not critical. For example, if the width of the pontoon is 80 feet, the tensile strength of the cable is 300 tons, and the constant induced moment is selected to be one-half the moment resisting capacity of the cable, then the center of gravity of a 3000 ton vessel can be located within a tolerance of 4 feet to either side of the centerline, without rotating the pontoon out of a substantially horizontal plane. Thus, the positioning of the vessel on the pontoon is not critical, as long as the four foot tolerance is not exceeded.

Figure 3:
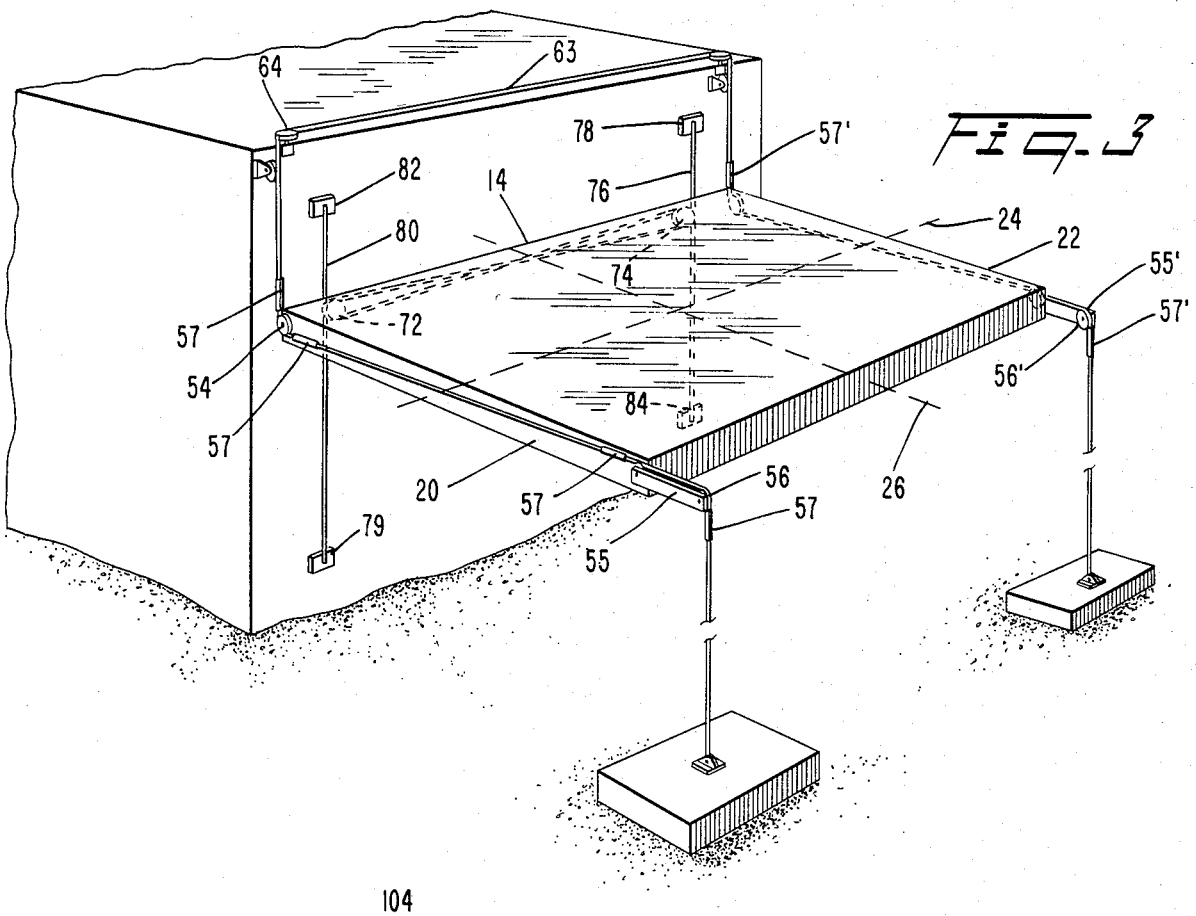
FIG. 3 is a transverse end elevational view of a further embodiment of the drydocking device according to the present invention.

The moment resisting capacity of the moment resisting arrangement may be increased by various mechanisms. Multiple cables may be used instead of a single moment resisting cable to increase the moment resisting capacity of the drydocking device. A block and tackle arrangement may also be employed with the multiple cables to further increase the moment resisting capacity. In addition, the sheaves 56, 56' illustrated in FIG. 3 may be secured to extensions 55, 55' on the pontoon 12 for increasing the horizontal spacing between each pair of sheaves 54, 56, 54', 56'. Further, the cables 60, 60' may be guided to and from the sheaves 54, 56, 54', 56' in order to insure that the cables 60, 60' constantly engage the sheaves 54, 56, 54', 56'. With reference to FIG. 3, the guides may include tubes 57, 57' through which the cable passes.

Drydocking devices experience external moments which tend to simultaneously rotate the pontoon about both longitudinal and transverse lines passing through the center of bouyancy of the pontoon. Thus, a moment resisting arrangement as described above may extend across a transverse side for resisting moments about the longitudinal line and across a longitudinal side for resisting moments about the transverse line.

With reference to FIG. 3, external moments tending to rotate the pontoon about both longitudinal and transverse lines passing through the center of bouyancy are resisted by moment resisting arrangements positioned on both the longitudinal side 14 and the transverse sides 20, 22 of the pontoon 12. As illustrated in FIG. 3, transverse sides 20, 22 of the pontoon 12 are provided with moment resisting arrangements as described above with reference to FIG. 1. The first side 14 (a longitudinal side) of the pontoon 12 is also provided with a second additional moment resisting arrangement which is arranged in a plane generally perpendicular to the first-mentioned moment resisting arrangement.

The second additional moment resisting arrangement may be similar to the moment resisting arrangement described with reference to FIG. 2. However, as illustrated in phantom lines in FIG. 3, the moment resisting arrangement may be similar to that disclosed in U.S.

Pat. No. 3,559,606 issued to Gregory. Such an arrangement includes two double sheaves 72, 74 positioned on the first side 14 of the pontoon 12 with a sheave 72, 74 adjacent to each transverse side 20, 22. A third cable 76 extends downwardly from a first upper portion 78 of the fixed structure 16 around the sheaves 74, 72 and across the first side 14 to a first lower portion 79 of the fixed structure 16. A fourth cable 80 extends from a second upper portion 82 of the fixed structure 16 around the sheaves 72, 74 to a second lower portion 84 of the fixed structure 16. With moment resisting arrangements provided on both transverse sides 20, 22 and a longitudinal side 14 of the pontoon as illustrated in FIG. 3, external moments tending to simultaneously rotate the pontoon about both the longitudinal and transverse lines passing through the center of bouyancy are resisted.

Figure 4:
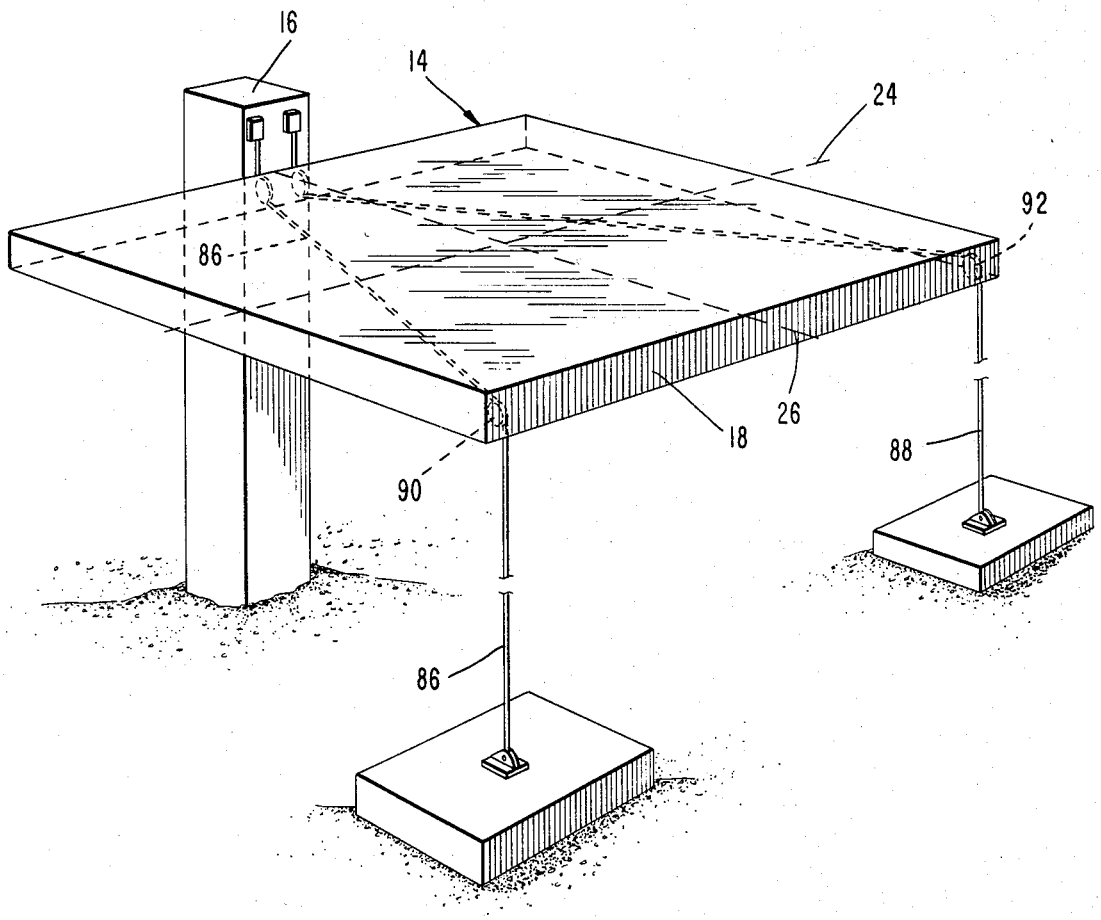
FIG. 4 is perspective view of a further embodiment of the moment resisting arrangement of the drydocking device according to the present invention.

With reference to FIG. 4, an alternate embodiment of the present invention is provided wherein a moment resisting cable is positioned to simultaneously resist external moments about both the longitudinal and transverse lines that pass through the center of bouyancy of the pontoon. The pontoon 12 is positioned with the first side 14 adjacent to the fixed structure 16' arranged centrally along the longitudinal axis 24 of the pontoon 12. As illustrated in FIG. 4, the fixed structure 16 may be a pier or a piling projecting above the water surface 28. Two moment resisting arrangements are employed wherein moment resisting cables 86, 88 are extended from the fixed structure 16' at an angle across the pontoon 12 to opposite corners 90, 92 adjacent to the second side 18 of the pontoon 12. With the above-described embodiment, each of the cables 86, 88 resists moments about both the longitudinal and transverse lines passing through the center of bouyancy of the pontoon.

Alternatively, a corner of the pontoon adjacent to the first side may be positioned adjacent to the fixed structure. A single moment resisting arrangement may then be used wherein a single cable extends diagonally across the pontoon to an opposite corner adjacent to the second side. In the embodiment illustrated in FIG. 5 or in the alternative embodiment described above, suitably arranged permanent void tanks and/or permanent ballast tanks may be situated within the pontoon to create induced moments about both the longitudinal and transverse lines passing through the center of bouyancy of the pontoon.

When two moment resisting arrangements having two moment resisting cables are employed, it is advantageous if equal tension can be maintained in both cables. One arrangement for maintaining equal tension within the cables is to interconnect the cables. With reference to FIG. 3, the cables 60, 60' employed in the moment resisting arrangements on the transverse sides 20, 22 of the pontoon 12 are interconnected by a cable section 63. Tension on the cable 60 is then transmitted through the cable section 63 to the additional cable 60' to equalize the tension within the cables 60, 60'. The direction of the cables 60, 60' is changed by sheaves 94, 96 mounted on the fixed structure 16.

Figure 5:
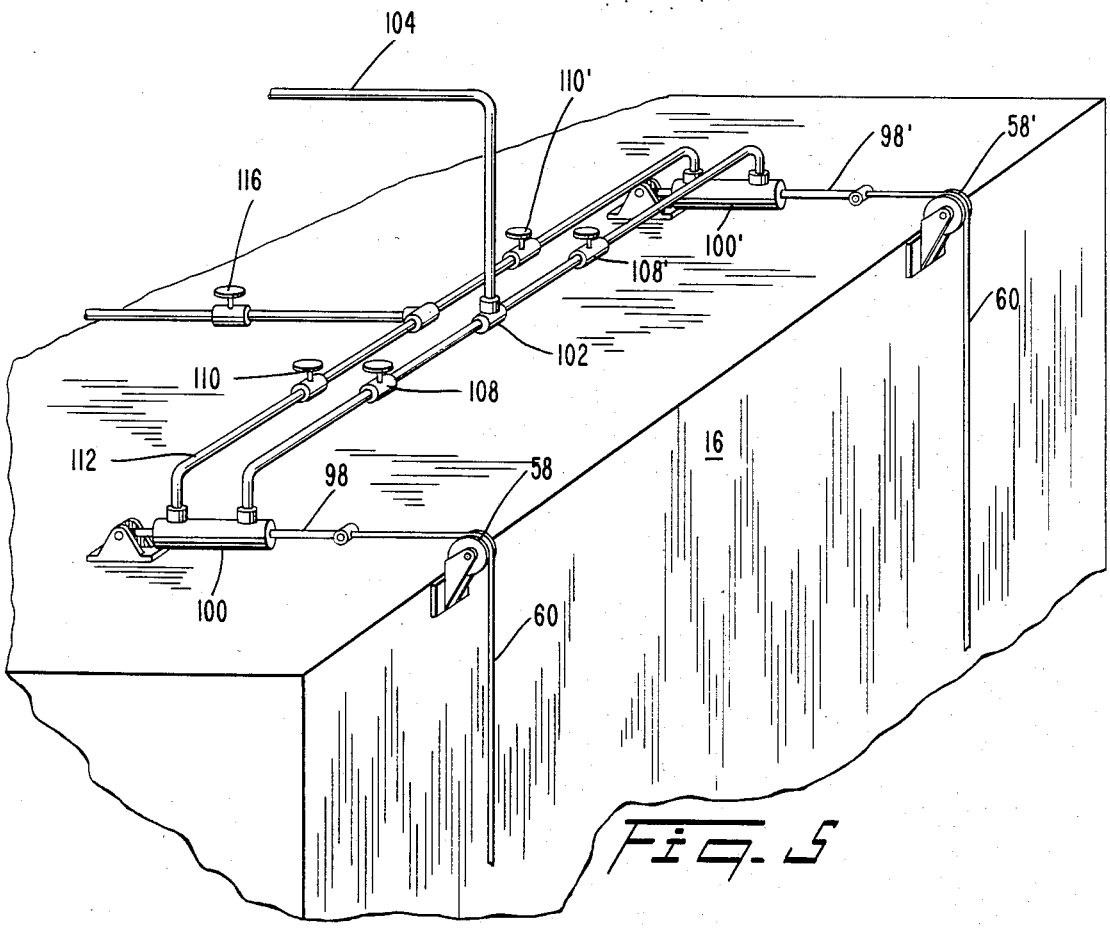
FIG. 5 is a schematic view of an arrangement for maintaining equal tension in moment resisting cables employed in the moment resisting arrangement of the present invention.

A further embodiment of an arrangement for maintaining equal tension in the cables is illustrated in FIG. 5 wherein the tension in the cables is hydraulically equalized. Each end 58, 58' of the cables 60, 60' is secured to a respective piston rod 98, 98' of an hydraulic ram 100,100', respectively. Each hydraulic ram 100, 100' is mounted on the fixed structure 16. An inlet valve 102 in an inlet conduit 104 controls the flow of fluid from a fluid reservoir (not shown) to ram inlet conduits 106, 106'. Each ram inlet conduit 106, 106' is provided with a ram inlet valve 108, 108' for interrupting the flow of fluid to a respective ram 100,100'. Ram outlet valves 110, 110' are also provided in ram outlet conduits 112, 112' for controlling the flow of fluid from each ram 100,100'. Each ram outlet conduit 112, 112' communicates with an outlet conduit 114 for returning fluid to the reservoir. An outlet valve 116 is positioned in the outlet conduit 114 between the ram outlet conduit 112, 112' and the reservoir. The valves may be automatically or manually controlled to selectively deliver fluid from the reservoir into the rams 100,100' and to selectively withdraw fluid from the rams 100,100' to the reservoir.

In operation, the inlet valve 102 and the ram inlet valves 108, 108' are initially opened to withdraw the piston rods 98, 98' within the rams 100, 100' and thereby eliminate slack in the cables 60, 60'. Fluid exhausts to the reservoir from the rams 100, 100' through the ram outlet valves 110, 110' in the outlet conduits 112, 112'. The pressure in both rams 100, 100' equalizes and thus, the tension in each cable 60, 60' is maintained at the same value. The ram inlet valves 108, 108' are then closed to maintain the piston rods 98, 98' in a withdrawn position which maintains equal tension within the cables 60, 60'. Fluid may also be introduced into the rams 100, 100' through the outlet conduit 114 and ram outlet conduits 112, 112' for extending the piston rods 98, 98'.

It is noted that the outlet conduit from one ram may be cross-connected to inlet conduit for the other ram which cross-connection permits controlled positioning of the pontoon in any plane, i.e., the pontoon may be purposely tilted out of the horizontal plane. It is further noted that the tension within the cables may be pneumatically equalized as well as hydraulically equalized.

Additionally, slack may be created in the cables either by extending the piston rods 98, 98' or by providing additional lengths of cable to allow the pontoon to move horizontally which enables pontoon to be used as a transfer device.

The principles, preferred embodiments and modes of operation of the present invention have been described in the foregoing specification. The invention which is intended to be protected herein, however, is not to be construed as limited to the particular embodiments disclosed, since these embodiments are to be regarded as illustrative rather than restrictive. Variations and changes may be made by others without departing from the spirit of the invention. Accordingly, it is expressly intended that all such variations and changes which fall within the spirit and scope of the claims be embraced thereby.

What is claimed is:

1. A drydocking device operable for providing a predetermined bouyancy for raising and lowering a vessel relative to a surface of a body of water, comprising:

a pontoon having at least one chamber within the pontoon;

means for selectively introducing air or water into the chamber within the pontoon for raising and lowering the pontoon, respectively;

a fixed structure positioned adjacent to at least a portion of a first side of the pontoon;

means for resisting moments tending to rotate the pontoon out of a substantially horizontal plane, including means for creating an induced moment in a first direction tending to rotate the first side downwardly, first rotary means attached adjacent to the first side of the pontoon and operable to rotate with respect thereto and second rotary means attached adjacent to a second side of the pontoon and operable to rotate with respect thereto, the second side being opposite to the first side, a cable extending from attachment means for securing a first end of the cable to the fixed structure, the cable passing around the first rotary means, across the pontoon and around the second rotary means to anchoring means for anchoring a second opposite end of the cable, the anchoring means being arranged adjacent to the second side of the pontoon; and the means for creating an induced moment including at least one permanent void tank located between the second side of the pontoon and an axis of the pontoon.

2. The device as claimed in claim 1, wherein the means for creating an induced moment comprises at least one permanent ballast tanks located between the first side of the pontoon and an axis of the pontoon.

3. A drydocking device operable for providing a predetermined bouyancy for raising and lowering a vessel relative to a surface of a body of water, comprising:

a pontoon having at least one chamber within the pontoon;

means for selectively introducing air or water into the chamber within the pontoon for raising and lowering the pontoon, respectively;

a fixed structure positioned adjacent to at least a portion of a first side of the pontoon; and means for resisting moments tending to rotate the pontoon out of a substantially horizontal plane, including means for creating an induced moment in a first direction tending to rotate the first side downwardly, first rotary means attached adjacent to the first side of the pontoon and operable to rotate with respect thereto and second rotary means attached adjacent to a second side of the pontoon and operable to rotate with respect thereto, the second side being opposite to the first side, a cable extending from attachments means for securing a first end of the cable to the fixed structure, the cable passing around the first rotary means, across the pontoon and around the second rotary means to anchoring means for anchoring a second opposite end of the cable, the anchoring means being arranged adjacent to the second side of the pontoon; and the means for creating the induced moment including:

at least one permanent void tank located between the second side of the pontoon and an axis of the pontoon, the permanent void tank creating a first variable induced moment in the first direction, at least one permanent ballast tank located between a first side of the pontoon and the axis of the pontoon, the permanent ballast tank creating a second variable induced moment in the first direction, the second variable induced moment varying inversely with the first variable induced moment such that a sum of the first and second variable induced moments is a constant induced moment.

4. A drydocking device operable for providing a predetermined bouyancy for raising and lowering a vessel in relation to a surface of a body of water, comprising:

a pontoon having at least one chamber within the pontoon;

means for selectively introducing air or water into the chamber within the pontoon to create a predetermined bouyant force for raising and lowering the pontoon, respectively;

a fixed structure positioned adjacent to at least a portion of a first side of the pontoon; and means for resisting moments tending to rotate the pontoon out of a substantially horizontal plane, including at least one permanent void tanks positioned between an axis of the pontoon and a second side of the pontoon opposite to the first side, the permanent void tank creating a first variable induced moment in a first direction tending to rotate the first side downwardly, at least one permanent ballast tanks located between the first side of the pontoon and the axis of the pontoon, the permanent ballast tank creating a second variable induced moment in the first direction, the second variable induced moment varying inversely with the first variable induced moment, the permanent void tank and the permanent ballast tank having relative sizes and having relative distances from the axis of the pontoon such that a sum of the first and second variable induced moments is a constant induced moment in the first direction, a first rotary means attached to a first transverse side of the pontoon and operable to rotate with respect thereto, the first transverse side extending between the first and second sides, a second rotary means attached to the transverse side of the pontoon and operable to rotate with respect thereto, a moment resisting cable extending from an attachment means for attaching a first end of the cable to the fixed structure, the cable passing under the first rotary means and over the second rotary means to an anchoring means for anchoring a second opposite end of the cable, the anchoring means being positioned adjacent to the second side of the pontoon, the cable extending across the first transverse side of the pontoon, the cable having a moment resisting capacity sufficient to resist first moments in the first direction, the first moments including the constant induced moment, and the constant induced moment resisting second moments in a second direction opposite to the first direction.

5. A drydocking device operable for providing a predetermined bouyant force for raising and lowering a vessel in relation to a surface of a body of water, comprising:

a pontoon having at least one chamber within the pontoon;

means for selectively introducing air or water into the chamber within the pontoon for raising and lowering the pontoon, respectively;

a fixed structure positioned adjacent to at least a portion of a first side of the pontoon; and means for resisting moments tending to rotate the pontoon out of a substantially horizontal plane, including means for creating induced moments in both a first direction tending to rotate the pontoon about a first line parallel to a first axis of the pontoon and passing through a center of bouyancy of the pontoon, and in a second direction tending to rotate the pontoon about a second line parallel to a second axis of the pontoon and passing through a center of bouyancy of the pontoon, the second axis of the pontoon being perpendicular to the first axis, a first rotary means attached adjacent to the first side of the pontoon and operable to rotate with respect thereto, and a second rotary means attached adjacent to a second opposite side of the pontoon and operable to rotate with respect thereto, the second rotary means being positioned across the pontoon from the first rotary means, a moment resisting cable extending from a attachment means for attaching a first end of the cable to the fixed structure, the cable passing around the first and second rotary means to an anchoring means for anchoring a second opposite end of the cable, the anchoring means being positioned adjacent to the second side of the pontoon beneath the second rotary means, the cable extending at an angle with respect to both the first axis and the second axis of the pontoon, the cable having a moment resisting capacity sufficient to resist moments in both the first and second directions, the moments including the induced moments.

6. A drydocking device operable for providing a predetermined bouyancy for raising and lowering a vessel relative to a surface of a body of water, comprising:

a pontoon having at least one chamber within the pontoon;

means for selectively introducing air or water into the chamber within the pontoon for raising and lowering the pontoon, respectively;

a fixed structure positioned adjacent to at least a portion of a first side of the pontoon;

means for resisting moments tending to rotate the pontoon out of a substantially horizontal plane, including means for creating an induced moment in a first direction tending to rotate the first side downwardly, first rotary means attached adjacent to the first side of the pontoon and operable to rotate with respect thereto and second rotary means attached adjacent to a second side of the pontoon and operable to rotate with respect thereto, the second side being opposite to the first side, a cable extending from attachment means for securing a first end of the cable to the fixed structure, the cable passing around the first rotary means, across the pontoon and around the second rotary means to anchoring means for anchoring a second opposite end of the cable, the anchoring means being arranged adjacent to the second side of the pontoon; and the means for creating an induced moment including at least one permanent ballast tank located between the first side of the pontoon and an axis of the pontoon.

* * * * *